US005894600A

United States Patent [19]

Chênefront

[11] Patent Number: 5,894,600

[45] Date of Patent: Apr. 20, 1999

[54] TRANSFORMABLE AND/OR METAMORPHOSABLE GARMENT

[76] Inventor: Genevieve Chênefront, 60 Vallon de Barla Le Val d'azur, 06200 Nice, France

[21] Appl. No.: 08/860,999

[22] PCT Filed: Jan. 12, 1996

[86] PCT No.: PCT/FR96/00057

§ 371 Date: Sep. 18, 1997

§ 102(e) Date: Sep. 18, 1997

[87] PCT Pub. No.: WO96/21368

PCT Pub. Date: Jul. 18, 1996

[30] Foreign Application Priority Data

Jan. 12, 1995 [FR] France ..... 9500296

[51] Int. Cl.[6] ..... A41D 27/00

[52] U.S. Cl. ..... 2/69; 2/70; 2/243.1; 2/105; 2/213

[58] Field of Search ..... 2/70, 243.1, 244, 2/69, 72, 77, 79, 106, 105, 115, 227, 213, 119, 126

[56] References Cited

U.S. PATENT DOCUMENTS

| | | | |
|---|---|---|---|
| 459,106 | 9/1891 | Fifield | 2/70 |
| 1,137,659 | 4/1915 | Oilar | 2/70 |
| 1,489,046 | 4/1924 | Thompson | 2/70 |
| 2,493,531 | 1/1950 | Fitches | 2/115 |
| 2,722,686 | 11/1955 | Hoskings | 2/74 |
| 4,683,595 | 8/1987 | Cash | 2/76 |
| 4,815,145 | 3/1989 | Chow | 2/67 |
| 4,961,234 | 10/1990 | Leibman | 2/408 |
| 5,083,316 | 1/1992 | Kuehner | 2/67 |
| 5,592,691 | 1/1997 | Ronald | 2/69 |
| 5,628,064 | 5/1997 | Chung | 2/70 |

FOREIGN PATENT DOCUMENTS

| | | | |
|---|---|---|---|
| 2074752 | 10/1971 | France . | |
| 2399810 | 3/1979 | France . | |
| 2598892 | 11/1987 | France . | |
| 93 200 62 | 4/1994 | Germany . | |
| 1510826 | 9/1989 | U.S.S.R. | 2/70 |
| WO89/10706 | 11/1989 | WIPO . | |
| WO93/25101 | 12/1993 | WIPO . | |

*Primary Examiner*—Amy Vanatta
*Attorney, Agent, or Firm*—Leydig, Voit & Mayer

[57] ABSTRACT

The invention relates to a fully modular and evolutive transformable garment obtained by a combination amongst multiple combinations of a plurality of instantaneously removable modules (1–17) which is metamorphosable. According to the invention, the modules (1–17) are interchangeable, substantially complementary by degrees, composite, irregular and optionally heterogeneous. Each module is made lying flat, generally shaped and costumized, and comprises at least on each of the edges to be assembled a means for rapidly fixing the edges to each other. The modules are comprised of a plurality of basic modules (7, 9, 11, 12) and of a plurality of complementary modules (1, 2, . . . ). Each module may be cut in any way as to the material used so that it can be adapted to other modules. Preferably, each module is polyvalent.

15 Claims, 10 Drawing Sheets

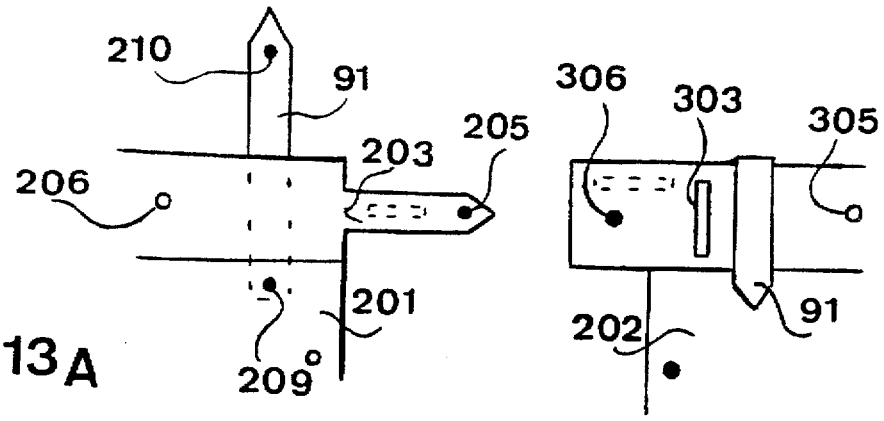
FIG 13A
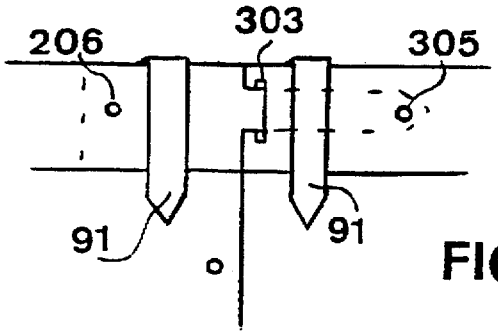
FIG 13B
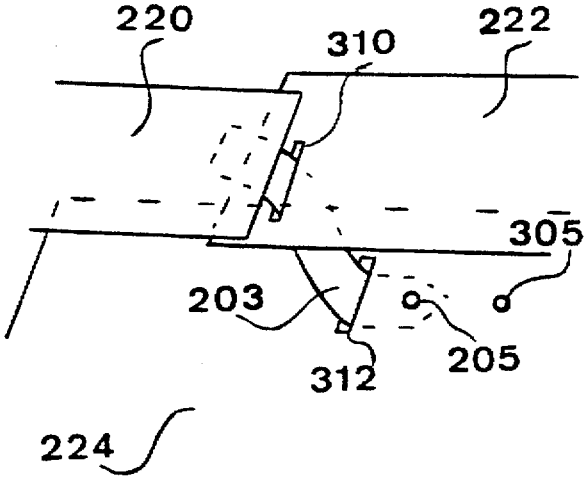
FIG 14
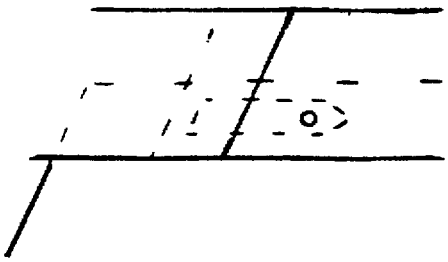

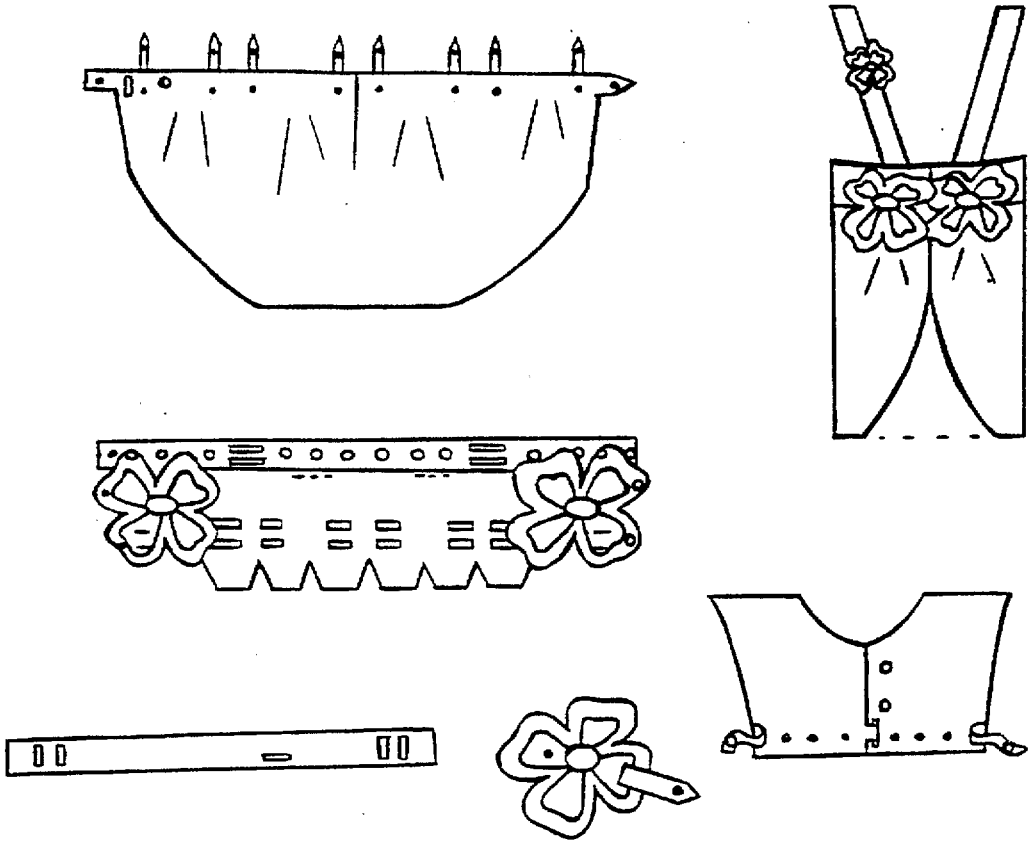
FIG 16
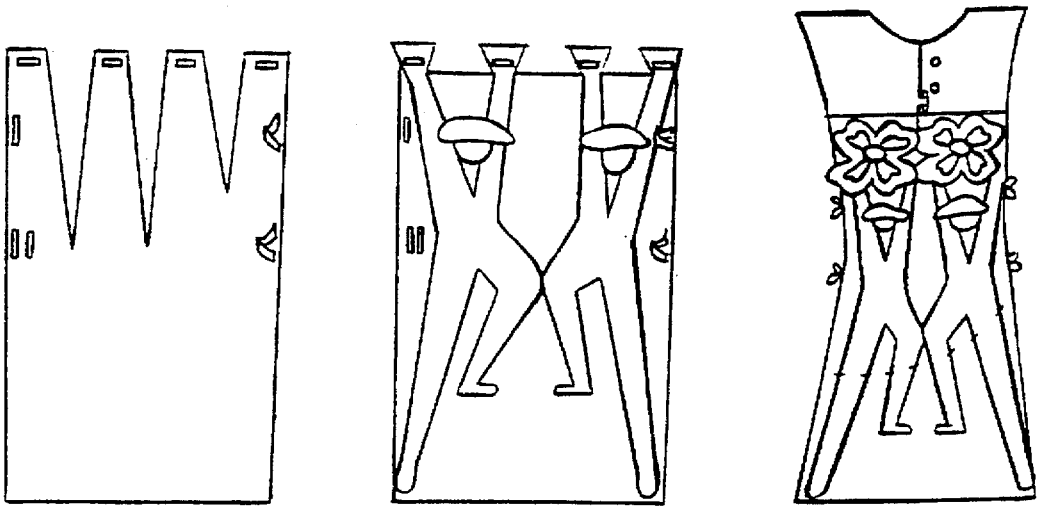

TRANSFORMABLE AND/OR METAMORPHOSABLE GARMENT

BACKGROUND OF THE INVENTION

This invention concerns a transformable and evolving garment obtained from one combination among many possible combinations of a variety of detachable and interchangeable modules, the lower part of which is instantaneously metamorphosable. It also concerns a module for such a garment.

Such garments have numerous applications, because they are suitable in particular for children, for adults, for dolls, and even for domestic animals.

One is familiar with garments made up from several general parts which can be removed or added in order to achieve a transformation of the garment, as described in document FR-A-1 470 315 and FR-A-1 520 507. According to document FR-A-2 307 482, trousers can be transformed into shorts, and vice versa. Document FRA-A-2 567 726 describes a universal garment which can constitute trousers, a jacket or a skirt, according to the wishes of the user. Document FR-A-2 433 913 relates to a concept according to which the various parts of the document, such as sleeves, legs, etc., are detachable.

Document FR-A-2 593 356 proposes a similar garment, presenting a system to camouflage the connections between the detachable parts.

Document FR-A-2 079 865 concerns a garment which is obtained by the association of parts which can be assembled from simple geometrical shapes. This also applies to document WO-A-89/10706, which concerns a garment which can be created using a basic pattern in the form of a diamond ("whose long diagonal is parallel to the main axis of the body"), and completed by means of triangles.

Document WO-A-93/25101 describes a "metamorphosis" system which can be used to alter the external appearance of a given garment. In practice this does not in fact consist of a metamorphosis system, but rather to a simple, rapid alteration in the appearance of the given garment, which avoids the need to remove the whole garment during the change. To this end, the garment has several movable parts (collar, sleeves, etc.) which can be attached simply to a main part. This type of garment is very useful in the entertainment business.

Document FR-A-2 074 752 concerns one basic element "created for the human body", of a tunic type, forming the support for a variety of "variants" which are detachable from the support in order to change the appearance of the final garment. The variants cannot be attached to each other however. Furthermore, although the "variants" are complementary, they do not form part of the basic element.

In other words, all of these documents describe diverse solutions involving the detachability of certain parts, in volume, of a garment (hood, legs, sleeves, etc.), or involving the joining together of simple geometrically shaped parts in order to form one complete piece of abric which can be used to create a garment or the covering for an item of furniture. These proposed solutions never allow a garment to be transformed radically, and/or a garment to be metamorphosed totally, using simple modules made up flat.

It should be pointed out here that the words "metamorphose" or "metamorphosis" are used semantically when there is such a significant change of shape that the initial object is no longer recognisable (e.g. a skirt into trousers, or vice versa).

SUMMARY OF THE INVENTION

The purpose of this invention is to allow clothing shapes to be evolved using detachable or removable modules in a way which allows the user the freedom to fabric which can be used to create a garment or the covering for an item of furniture. These proposed solutions never propose to transform a garment radically, and/or to metamorphose a garment totally, using simple modules made up flat.

Document DE-U-9320062 describes an object, such as a garment, consisting of a basic module and at least one possible addition, together with an element which can be assembled to the basic model in order to alter the dimensions of this object. Thus this known solution does not allow the garment concerned to be radically transformed or metamorphosed.

It should be pointed out here that the words "metamorphose" or "metamorphosis" are used semantically when there is such a significant change of shape that the initial object is no longer recognisable (a skirt into trousers, or vice versa).

The purpose of this invention is to allow clothing shapes to be evolved using detachable or removable modules in a way which allows the user the freedom to create, i.e., each to make up, instantaneously, several diverse, original, and novel garments, from a given set of modules which were initially created flat in the main.

This invention therefore concerns an entirely transformable and evolving modular garment obtained from one combination among many possible combinations of a variety of instantaneously detachable modules, the lower part of which in particular (trousers, skirt, or equivalent) is metamorphosable.

According to the invention, the entirely modular, evolving, transformable multiple garment can be created from detachable modules which can be assembled together from a variety of possible combinations, characterised in that the modules of a given set are interchangeable, more or less complementary by degrees, composite, irregular, and heterogeneous where appropriate. Each model is created flat, generally modelled and/or individualised, and includes, on at least one of its attachable edges, a means for rapid attachment between the parts; that each module is cut in any manner whatever in relation to the material of the garment, in a manner enabling it to be matched to the other modules, so that by assembling together at least the modules from the set of modules specifying a particular garment, different structures of the garment will be obtained, transforming this garment into another garment of the same nature or of a different nature, such as an apron into a dress, or a bare-back blouse into a conventional blouse, or radically metamorphosing this garment into another garment of a totally different nature, such as a dress into a slip or a skirt into trousers.

It is preferable that each module should be polyvalent.

BRIEF DESCRIPTION OF THE DRAWINGS

It is also preferable that the means of attachment should include at least one method selected from among press-studs, zip fasteners, slide fasteners, adhesive fasteners, buttons, rings, links, tabs and loops, reinforced eyes or buttonholes, clips, hooks, and combinations of these. When the chosen method of attachment includes a set of male elements and a set of female elements, these elements are distributes in such a manner that they will be complementary, whatever their configuration.

It is preferable also that the means of attaching the modules to each other should include at least one tab fixed to one of the modules and passing through at least one corresponding opening or eye created in the other module. This will be arranged in such a manner as to allow at least three modules to be attached at the same point. In this latter case, the method used to attach the intermediate modules should preferably be of the female reinforced eye type.

The tab should preferably be attached at least 1 cm back from the edge of the module concerned.

Figure 1A:
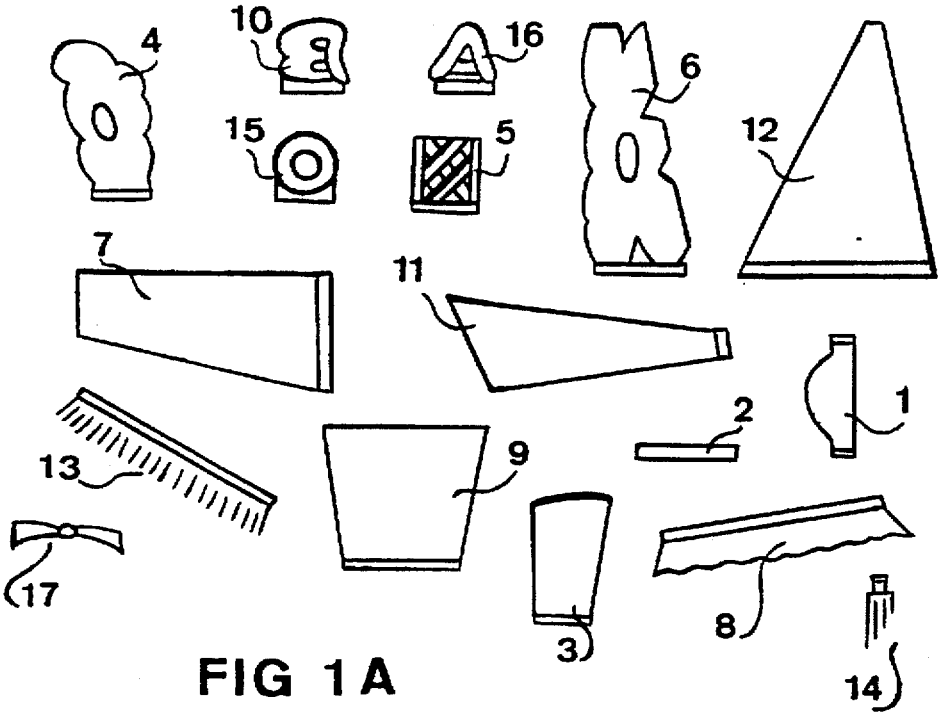

FIG. 1A is a schematic representation of a set of modules as described in the invention.

Figure 1B:
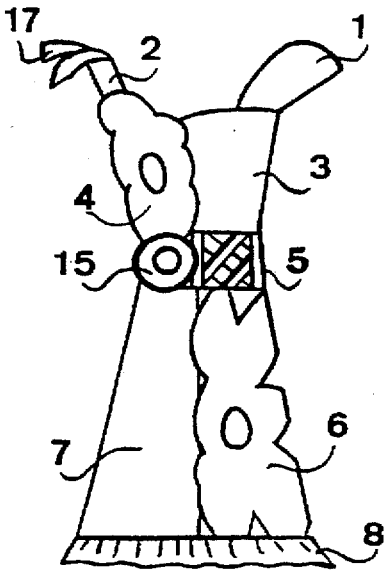
Figure 1C:
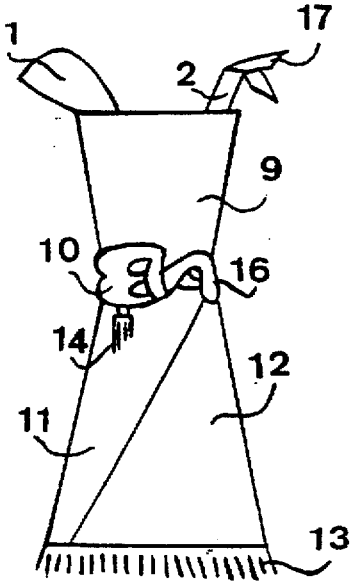

FIGS. 1B and 1C represent, respectively, the front and the back of a garment created using the modules of FIG. 1A.

FIGS. 2A to 2E are schematic illustrations of the metamorphosis or transformation of a modular garment, and in particular to allow a garment to be flared at the top or the bottom.

Figures 3A, 3B, 3C, 3D, 3E, 3F, 3G:
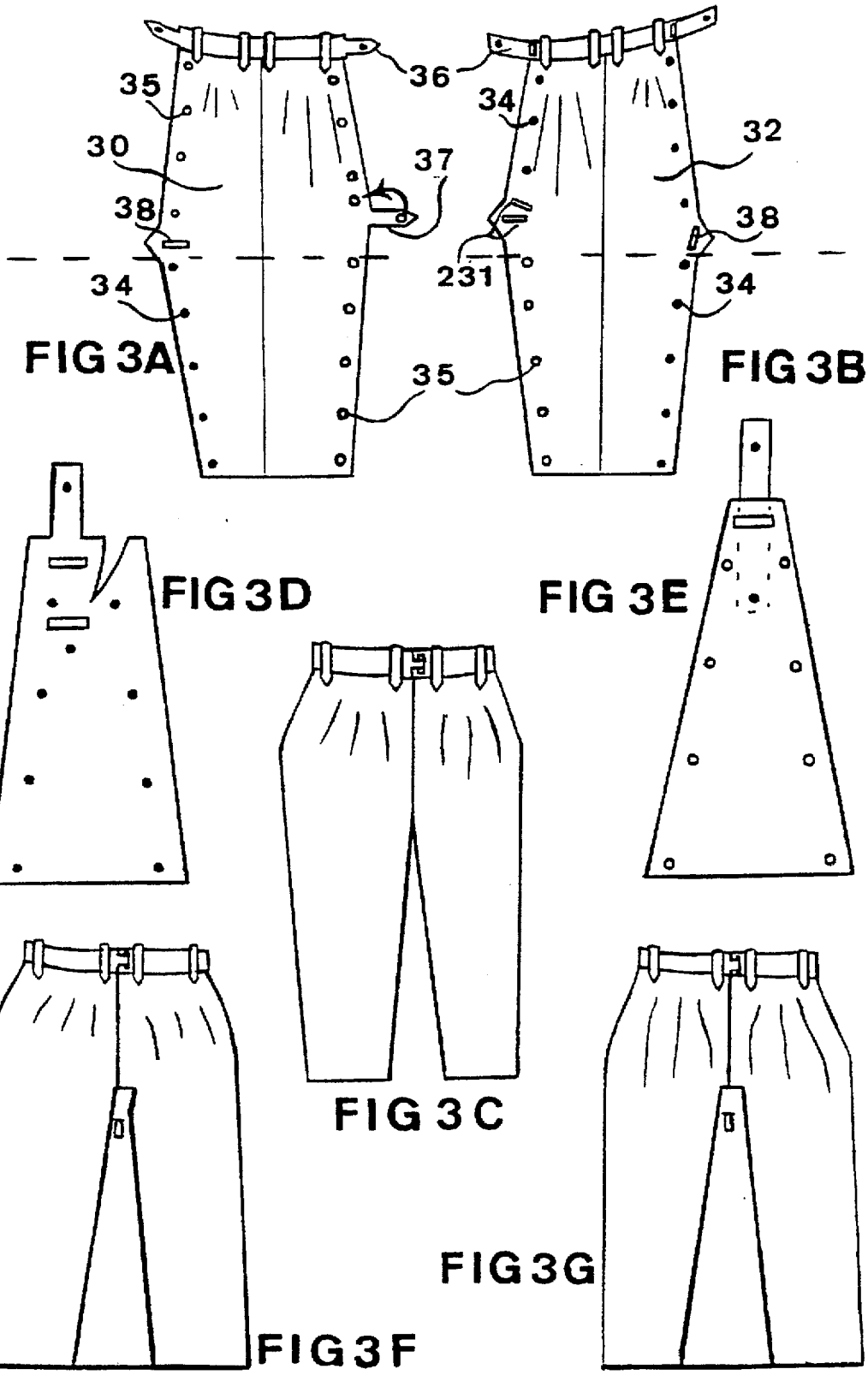
Figure 4A:
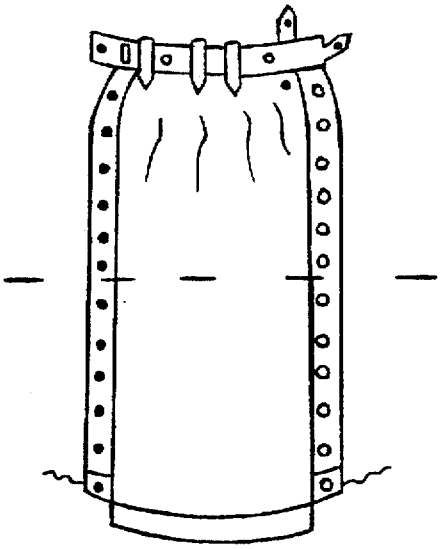
Figure 4B:
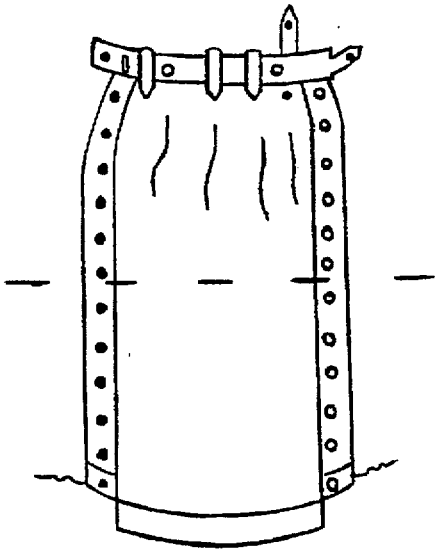

FIG. 3 is a schematic representation of the metamorphosis of trousers (FIG. 3C into a skirt (FIGS. 3F and 3G) using additional modules places at the front and the rear (FIGS. 3D and 3E).

Figure 5A:
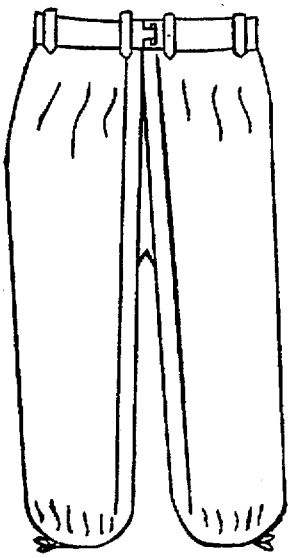
Figure 5B:
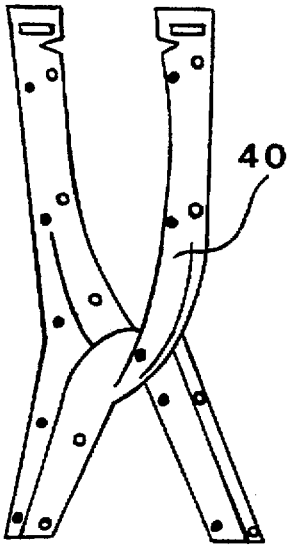

FIGS. 4A, 4B, 5A and 5B illustrate the metamorphosis of a skirt (FIGS. 4A and 4B) into trousers (FIG. 5A), using one additional module (FIG. 5B).

Figure 6:
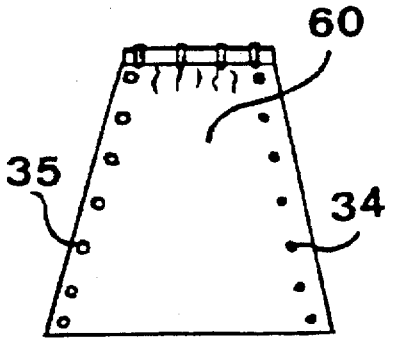
Figure 7:
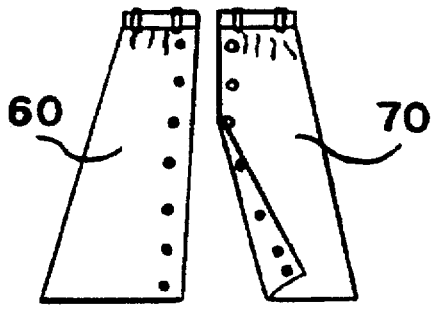

FIG. 6 is a schematic illustration of a basic lateral module, while FIG. 7 illustrates a method for joining two basic modules such as that in FIG. 6.

Figure 8:
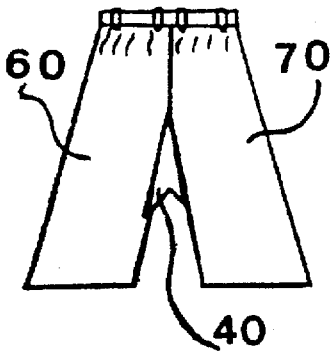

FIG. 8 illustrates the positioning of the same module as shown in FIG. 5B in order to metamorphose the skirt of FIG. 7 into wide or sarhouel trousers as shown.

Figure 9:
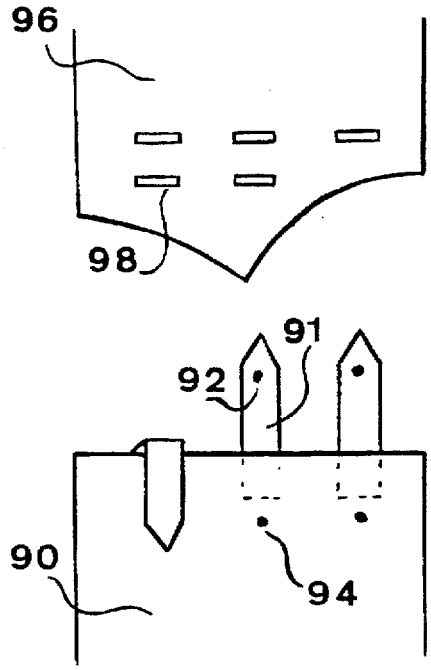

FIG. 9 illustrates the joining of one part to another using tabs.

Figure 2A:
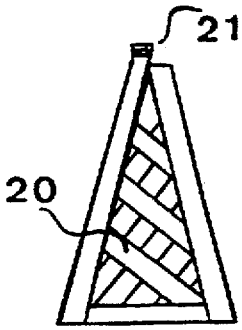
Figure 2B:
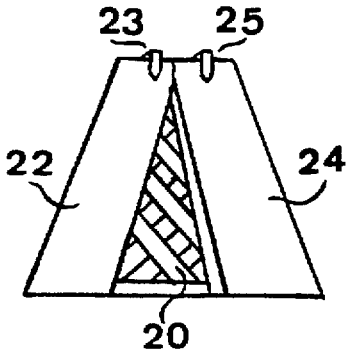
Figure 2C:
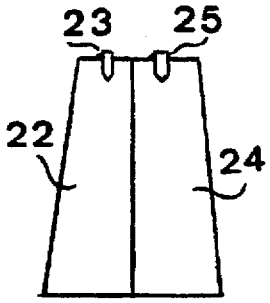
Figure 2D:
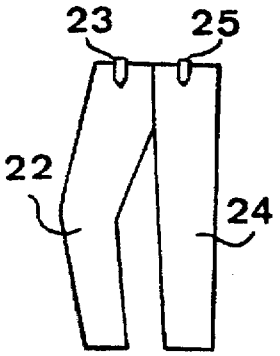
Figure 10:
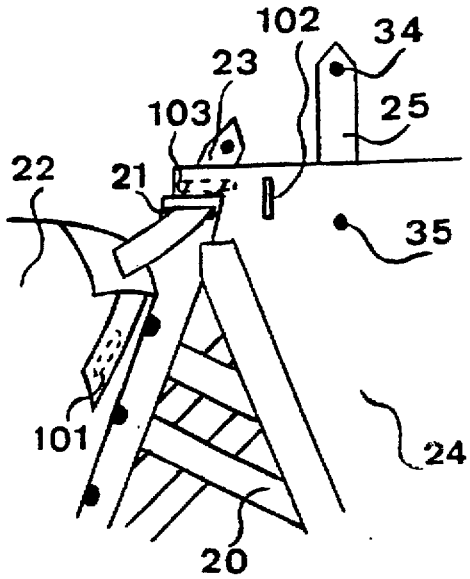

FIG. 10 illustrates the central join of the modules of FIG. 2B.

Figure 11:
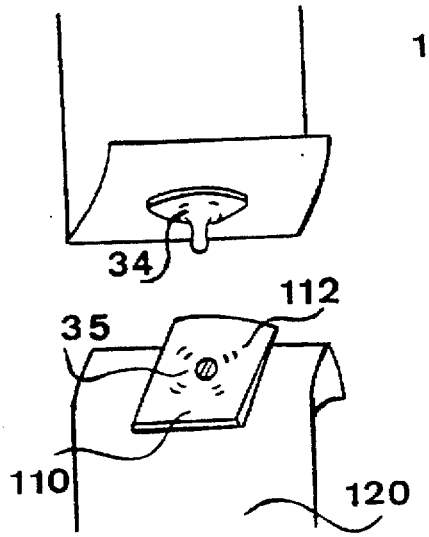
Figure 12:
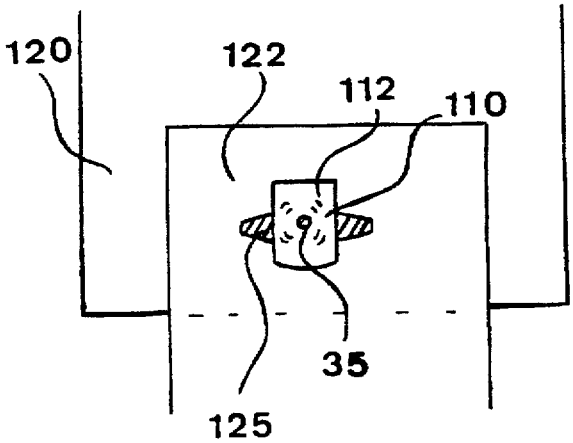

FIG. 11 schematically represents an improved press-stud used for attaching one or more modules using the method illustrated in FIG. 12.

FIG. 13 shows the advantageous use of slots and tabs as a means of attaching modules together, usually at the waist.

FIG. 14 shows the use of slots and tabs for the joining of three modules.

Figure 15:
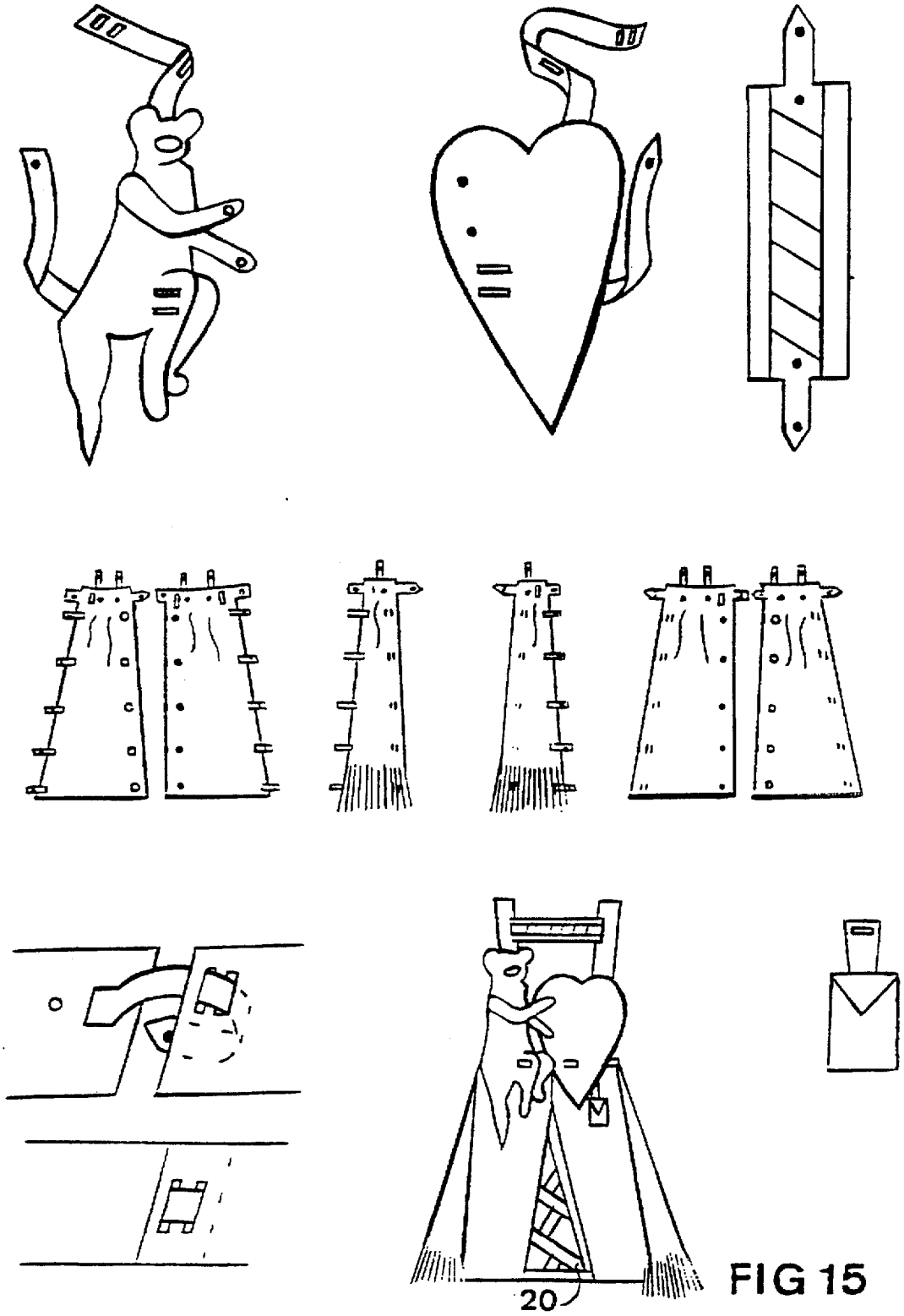

FIG. 15 illustrates a set of modules intended to create a dress which widens and flares toward the bottom.

FIG. 16 illustrates the transformation of a tunic into a dress.

FIGS. 17 and 18 show the preferred methods for attachment of the various modules.

DETAILED DESCRIPTION OF THE PREFERRED EMBODIMENTS

By reference to the figures, as they would be understood by a dressmaker or tailor, it is possible to create a transformable and/or metamorphosable garment by means of a combination of elements, parts or modules created flat, which are detachable, reversible, polyvalent and/or complementary. These modules can be tailored, cut, of simple or complex shape, diversified or united, or even embossed or including heterogeneous materials (textiles, wood, metal, plastic, etc.). They are designed to be interchanged in all directions, and to be capable of being divided into as many parts as may be necessary or desired. They can also be placed at different points and/or in different positions on the final garment.

These modules can therefore be added or taken away, can add volume to the garment or remove it, can be superimposed or inserted in order to enlarge or widen, and can be purely functional or merely used to decorate the final garment.

As an example, FIG. 1A shows a set of seventeen modules, numbered 1 to 17, as specified in the invention, and FIGS. 1B and 1C show the front and the back of a garment which has been made up from the modules of FIG. 1A. Modules 7, 9, 11 and 12 can be described at the "basic modules", because they determine the shapes which occupy the main role. The other modules are known as "additional modules", because they are used as complements to the basic modules, for either functional or aesthetic ends.

It is possible, for the lower element for example, to make up a skirt or trousers quite simply, using not only two of the basic modules, but also using one basic module and attaching one of the additional modules to it.

Also certain modules have to be complementary by degrees, since they are intended for the mutation of a garment. Other modules are designed exclusively for a specific part of the garment, though it is preferable that they should be polyvalent nevertheless. This applies particularly to the modules acting as basic modules, which determine the shapes which occupy the main role in the garment.

On one of its edges at least, each module has some means for its rapid attachment to other modules. This means of attachment includes at least one method selected from among press-studs, zip fasteners, slide fasteners, adhesive fasteners, buttons, rings, links, tabs and loops, eyes or buttonholes (reinforced or scalloped), clips, hooks, and combinations of these. In other words, there is no need for any special tool in order to assemble or separate the various modules.

When the chosen method of attachment includes a set of male elements and a set of female elements, these elements are distributed in such a manner that they will always be complementary, whatever their configuration. The means of attachment are therefore all positioned at more or less equal distances from each other in such a manner as to provide for total interchangeability of the modules to be assembled. We will return later to certain preferred methods of realising the means of attachment.

Figure 2E:
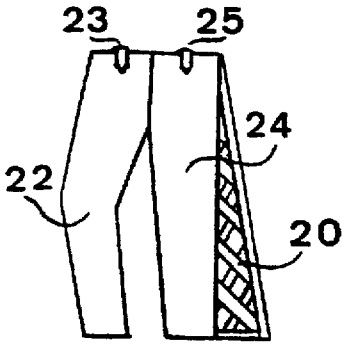

With reference now to FIGS. 2A to 2E, we see the metamorphosis of a skirt and of trousers, using additional modules such as those shown in FIG. 2A under reference 20. Additional module 20, approximately the shape of an isosceles triangle, in which the angle opposite to the base has tab with opening, reference 21, reinforced for example in order to assist its attachment, to another tab for example (not shown here, but which will be described in relation to other figures). Two basic modules, 22 and 24, are each made up from a textile support cut more or less flat, to go from the centre of the back to the centre of the front. Tabs 23 and 25 are provided to make the join with the upper part at belt level. When the two lateral edges corresponding to the basic modules, 22 and 24, are joined together, by means of a set of press-studs for example, we directly obtain a relatively straight skirt, like that shown in FIG. 2C. When an additional module, such as part 20 in FIG. 2A, is attached on either side between two basic modules, 22 and 24, a wider skirt results, as illustrated in FIG. 2B. The modules are joined to each other using press-studs. Module 20 is equally suitable for fitting to a skirt (FIG. 2B) and to the sides of trousers (FIG. 2E).

FIG. 3 illustrates the metamorphosis of trousers into a skirt. Two basic modules, 30 and 32, with claws on the belt, 36, form the lateral parts of the garment. The belt and the front and back edges of the modules are assembled rapidly as described below. This results in the trousers shown in FIG. 3C. It is obvious that the belt rises more at the back than the front. Asymmetry is provided in the modules in order to allow for that of the human body. At the comers, tab 37 and eyes 38 and 231 are used to form the join, as are press-studs 34 and 35, provided to form the inside leg of the trousers, as shown in FIG. 3C. By joining on additional modules, shown in FIGS. 3D and 3E, in which tabs and eyes are provided for joining up with those of modules 30 and 32, a skirt is obtained (the front and back of which are shown in FIGS. 3F and 3G), and other decorative modules can then be attached to this as required.

In FIG. 4, illustrations 4A and 4B show two lateral basic modules with gathers and tucks in the belt area. The belt is assembled as described below, as are the edges. The result is a skirt. This skirt will be metamorphosed into trousers using the additional module shown (the three-quarters view in FIG. 5B), which is manufactured using central stitching. This additional module is for fitting to the crotch area, for attachment to the belt using the tabs illustrated. Note the notches shown in FIG. 5B, which are provided to increase ease of movement. The drawstrings shown are finally inserted and knotted to result in baggy or sarhouel trousers. Obviously the various modules are interchangeable.

More simple variants are illustrated in FIGS. 6 to 8. The professional dressmaker will understand this process without difficulty. Two basic modules, 60 and 70, form a skirt. Insertion of additional module 40, corresponding fairly closely to that shown in FIG. 5B, metamorphoses the skirt into trousers, as shown in FIG. 8. This same additional module can also be adapted to other modules and to other configurations.

It is easy to see that numerous different creative models can thus be obtained easily and instantaneously, without the aid of special tools.

It is now desirable that we return to the methods employed for attaching the modules to each other. FIG. 9 illustrates a method used to join bottom and top modules (though not exclusively so, since additional modules can also be attached this way, as can be seen in other figures). Module 90 is fitted with tabs 91, the end of which contains one half of a press-stud, the other half of which is placed on module 90, so that it can be joined, after folding over tab 91, with its twin on the tab. The other module, 96, has a corresponding number of eyes designed so that tabs 91 are passed through them and then folded over.

FIG. 10 shows the central join of the modules shown in FIGS. 2B and 2E. Additional module 20 is fitted with attachment tab 21. Tab 23 of basic module 22 passes through the tab 21 eye of additional module 20, and then eye 103 in the other basic module, 24. After folding over, the part of the press-stud on tab 23 is pressed onto the corresponding part mounted on basic module 22, not shown in FIG. 10. In parallel fashion, basic module 22 has a horizontal tab, 101, fitted with an eye, reinforced for example, and intended to pass through vertical eye 102 in the other basic module, 24. The eye in horizontal tab 101 is traversed by tab 25 to form an attachment on the inside of module 24. This results in a reliable join, which is easy to manoeuvre.

All of the tabs are preferably stitched at least 1 cm from the inside edge, in order to favour the join, and to make it more or less invisible.

FIGS. 11 and 12 provide a schematic illustration of another method of implementation. The female part, 35, of the press-stud, is attached to substrate 110, which is virtually flat and oblong as shown. The ends of this are not attached to the module to be attached, 120, because it can be fixed only by four relatively-centred double holes, 112. Thus an intermediate module (FIG. 12) can have an eye, reinforced and oblong for example, into which substrate 110 is introduced perpendicularly. Thus when the male part, 34, of the press-stud is inserted, the three modules are fixed directly together. Although it was decided to illustrate the female part of the stud mounted on a substrate, it is equally possible to mount the male part, 34, on such a substrate.

Other preferred modes of implementation are now described as an illustration of the invention. In FIGS. 13A and 13B, all of the modules are fitted, particularly at the waist, with eyes 92, used for attachment to the top modules and/or other additional modules, and which are sewn on the front inside of the belt, at several centimetres from the edge, and attached on the outside by means of half press-stud 209 which mates with its twin press-stud 210. At its end, module 210 has a horizontal tab at its extremity fitted with a half press-stud, 205. The end of module 202 has an eye, 303. Tab 203 passes through eye 303, and the half press-stud at its end, 205, mates with half press-stud 305 provided on the inside of module 202, after passing through tab 91, which then forms an eye. Half press-stud 306 is then able to mate with half press-stud 206 on the inside, to hold everything together. The result obtained is illustrated in FIG. 13B. One can see that the attachment has become invisible here.

In FIG. 14, a similar arrangement is show, but involving three modules, 220, 222, and 224. Eyes 310 and 312 in modules 222 and 224 respectively, are used to receive tab 203 and allow press-studs 205 and 305 to mate inside module 224, to create an invisible attachment here also.

In FIG. 15, the professional dressmaker will recognise a set of modules capable of creating a dress which is widened and flared at the bottom. Note here that all modules overlap at their edges. Other methods of assembly can be used, and particularly if the joins remain invisible.

FIG. 16 shows the transformation of a shoulder-strap tunic into a sleeved dress through various associations, in accordance with the methods of this invention, using tabs as described here. The professional dressmaker will require no further instructions.

Figure 17A:
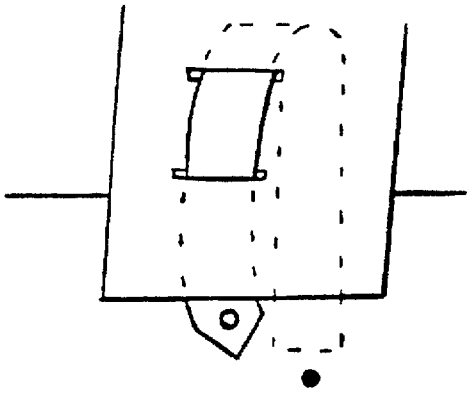
Figure 17B:
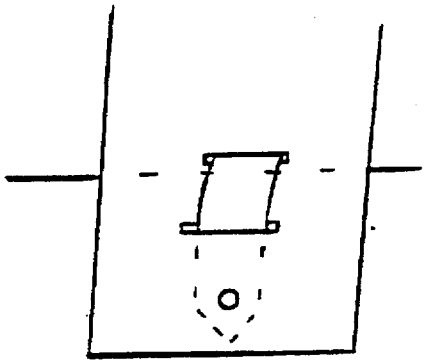
Figure 18A:
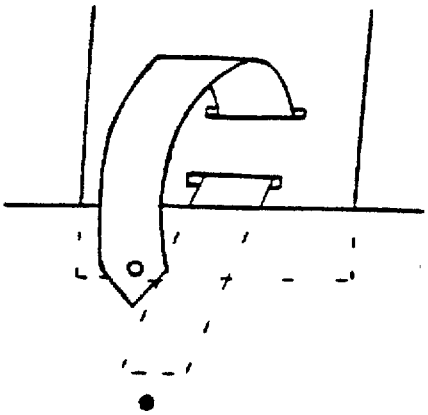
Figure 18B:
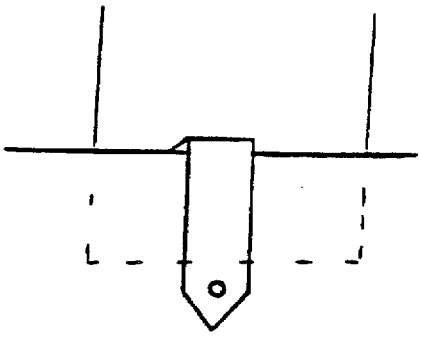

FIGS. 17A and 18A provide details of the attachment and assembly methods designed to make them more or less invisible, as can be seen in FIGS. 17B and 18B respectively. The modules can be superimposed on the inside or the outside.

It is obviously better that all tabs are sewn at least one centimeter from the edge in a manner which allows the modules to be assembled, superimposed, etc.

In the figures, the white half press-studs are invisible, and the black half press-studs are visible.

Although one has presented here what is considered to be the preferred methods from implementing this invention, it is obvious that the professional dressmaker will be able to make many changes and modifications while still remaining within the framework of the invention, as specified in the attached list of claims. In particular, although the preferred method of attachment may be tabs, it is by no means limited to this.

It will have been understood that the additional modules have either a purely decorative role or a functional role in the metamorphosis and/or transformation of the garment, or can have a role in the joining the basic modules, or indeed can have several of these roles simultaneously. It is obvious that the additional interchangeable modules are liable to present a variety of different surfaces.

The basic modules also obviously have the same role as the additional modules, namely to transform or metamorphose the modular garment of the invention.

In addition to the creative and aesthetic aspect for the user, the invention can also be said to have an educational aspect relating to the creation of clothing from a jig-saw of removable, interchangeable, and more-or-less interchangeable modules.

It can be understood easily that the more one adds new modules into the combination, the greater the number of ways in which the models can be varied. As an example, according to tests carried out with the prototypes using 26 modules, it is possible to create 140 different models. By adding one module, a further 5 models can be obtains, and another module makes possible a further 6 models, and so on.

I claim:

1. A transformable clothing arrangement comprising:

a set of modules, the set including a plurality of modules, each module of the plurality of modules being different in shape from and interchangeable with another of the plurality of modules, each module including at least one edge;

means for attaching the modules to each other coupled to the at least one edge, wherein the plurality of modules of the set are attached to each other to form a first complete garment, and when at least a first module at a first position in the first garment is interchanged with a second module at a second position in the first garment, a second complete garment is formed differing in shape from the first complete garment.

2. The transformable clothing arrangement in accordance with claim 1, wherein the set of modules is extensible to evolve by the addition of at least one module to the set to form a plurality of new individual garment structures.

3. The transformable clothing arrangement in accordance with claim 1 wherein each of said modules is polyvalent.

4. The transformable clothing arrangement in accordance with claim 1 wherein said means for attaching includes at least one device chosen from the group consisting of: press-studs, zip fasteners, slide fasteners, adhesive fasteners, buttons, rings, links, tabs and eyes, buttonholes, clips, and hooks.

5. The transformable clothing arrangement in accordance with claim 1 wherein said means for attaching the modules to each other includes at least a tab fixed to a first of said modules, and at least one eye coupled to a second of said modules, said tab passing through the at least one eye in said second module.

6. The transformable clothing arrangement in accordance with claim 5, wherein said tab is attached at least 1 cm from an edge of said first module.

7. The transformable clothing arrangement in accordance with claim 1 wherein said means for attaching is configured in a manner which allows the attachment of at least three modules at the same point.

8. The transformable clothing arrangement in accordance with claim 1 wherein said means for attaching comprises a female device, including a reinforced eye.

9. The transformable clothing arrangement in accordance with claim 1 wherein said means for attaching includes a set of male elements and female elements, the distribution of said male and female elements being arranged in such a manner that they are complementary, irrespective of the configurations.

10. The transformable clothing arrangement in accordance with claim 1 wherein the means for attaching comprises a press-stud having first and second elements which fit together, the first element being attached to a substrate, which is substantially flat, the substrate including a central part which has four double eyes allowing the substrate to be attached to the module, the substrate having ends of which are spaced from the module, the substrate being designed to pass through an eye in at least one other module.

11. The transformable clothing arrangement in accordance with claim 1 wherein the means for attaching comprises a set of tabs fixed to a first module and passing through at least one eye in a second module and returning and attaching to the first module.

12. The transformable clothing arrangement in accordance with claim 1 wherein one of the plurality of modules comprises a crotch-piece.

13. The transformable clothing arrangement as claimed in claim 1 wherein the first garment differs in type from the second garment.

14. The transformable clothing arrangement as claimed in claim 13 wherein the first garment comprises a pair of trousers and the second garment comprises a skirt.

15. A transformable clothing arrangement comprising:

a set of modules, the set including a plurality of modules attaching to each other to form a first garment, the plurality of modules including:

at least one basic module having a fixed position in the first garment;

a plurality of additional modules, each module of the plurality of additional modules being different in shape from and interchangeable with another of the plurality of additional modules, wherein when at least a first additional module at a first position in the first garment is interchanged with a second additional module at a second position in the first garment, a second garment is formed differing in shape from the first garment.

* * * * *